US006141829A

United States Patent [19]

Boyer

[11] Patent Number: 6,141,829

[45] Date of Patent: Nov. 7, 2000

[54] DOOR HINGE

[75] Inventor: Thomas J. Boyer, Wooster, Ohio

[73] Assignee: Stahl/Scott Fetzer Company, Wooster, Ohio

[21] Appl. No.: 09/265,093

[22] Filed: Mar. 9, 1999

[51] Int. Cl.[7] ..... E05D 7/00

[52] U.S. Cl. ..... 16/224; 16/381; 16/382

[58] Field of Search ..... 16/224, 273, 382, 16/381, 380, 268, 262, 265, 86.1, 86.2; 403/122, 140, 135

[56] References Cited

U.S. PATENT DOCUMENTS

| | | | |
|---|---|---|---|
| 610,243 | 9/1898 | Reno | 16/268 |
| 1,936,769 | 11/1933 | Olivet | 16/381 |
| 3,287,071 | 11/1966 | Tucker | 403/140 |
| 3,349,429 | 10/1967 | Suska | 16/382 |
| 3,488,792 | 1/1970 | Ashworth et al. | 16/86.2 |
| 3,510,986 | 5/1970 | Berkowitz | 16/380 |
| 3,594,049 | 7/1971 | Turner | 403/140 |
| 4,691,422 | 9/1987 | Tilgner et al. | 403/122 |
| 4,937,916 | 7/1990 | Redman | 16/245 |

*Primary Examiner*—Chuck Y. Mah
*Attorney, Agent, or Firm*—Watts, Hoffman, Fisher & Heinke Co., L.P.A.

[57] ABSTRACT

An adjustable quick release door hinge for connecting a door to a door frame comprises a hinge component, a hinge bracket, and a pin for connecting the hinge bracket to the hinge component. The hinge component includes a housing having an interior concave surface, an elongated portion extending from the housing and a rotatable bearing member contained in the housing. The bearing member has an arcuate portion and an aperture. Portions of the bearing member protrude from the interior of the housing. Each of the protruding portions is flat. A fastener device is used for connecting the hinge component to a door frame or door. The hinge bracket is attached to the other of the door or door frame. The pin extends from the hinge bracket and is received by the aperture of the bearing member of the hinge component for connecting the hinge bracket with the hinge component. Also featured is a quick release hinge component and a method of attaching a door to a door frame.

13 Claims, 2 Drawing Sheets

DOOR HINGE

TECHNICAL FIELD

This present invention relates generally to door hinges. More specifically, this invention relates to door hinge components and to methods of attaching a door to a door frame.

BACKGROUND OF THE INVENTION

Door hinges are typically of the stationary type. That is, one part of the door hinge is fixedly attached to a door frame and the other part of the door hinge is fixedly attached to a door. Each hinge part usually has a complementary sleeve such that when the hinge parts are mated together an elongated sleeve is formed in which a pin or rod is inserted to fasten the hinge parts together. The inserted rod or pin provides the door hinge with a pivot point about which the door can open and close.

Doors can be relatively bulky and heavy objects that are difficult to maneuver easily. As a result, installation and removal of a door is oftentimes troublesome and time consuming. Installation typically requires each door hinge part to be attached to the door and door frame in a precise position. The door is then held in place while a rod or pin is inserted to connect the hinge parts. The openings in each hinge part must be carefully aligned so that the rod or pin can be fully inserted. The pin or rod is usually press-fit into the openings of the door hinge. Alignment of the door is usually predetermined and not easily adjustable. Any adjustment typically requires repositioning the hinge parts on the door and door frame.

There are numerous ways in which a door can be removed from a stationary hinge. One way is to remove each hinge part from the door frame and door. Another way is by removing the rod or pin connecting the hinge parts which usually requires the openings in each hinge part to be perfectly aligned. The process of removing each rod or pin usually requires the door to be held in place so that the hinge parts remain aligned. Any degree of misalignment will generally make it more difficult to remove the rod or pin. Tapping and/or prying the rod or pin from the openings in the hinge parts is commonly required. Similarly, when installing a door using a stationary hinge, precise alignment of the hinge parts is required for the pin to be inserted.

SUMMARY OF THE INVENTION

The present invention advantageously overcomes the prior art difficulties of installing and removing doors. The present invention is directed to an adjustable, quick release door hinge. The inventive door hinge comprises a hinge component, a hinge bracket, and a pin for connecting the hinge bracket to the hinge component.

More specifically, the door hinge component comprises a housing and an elongated portion extending from the housing. The elongated portion is preferably threaded for adjustably attaching to an opening in an object. The housing includes an interior concave surface and a bearing member disposed therein. The bearing member contained in the housing has an arcuate portion and an aperture. The bearing member is substantially spherical and is rotatable within the housing. The bearing member includes opposing flat portions that protrude from the interior of the housing. Optionally, the housing may contain a bushing. The bushing is disposed against the interior concave surface and is preferably made from nylon.

A fastener connects the hinge component to a selected one of the door frame and the door. The fastener is preferably comprised of threads formed on the elongated portion of the hinge component and an opening in the door frame or door that receives the threads. The fastener advantageously allows fine tune adjustment of the door to the door frame, which is influenced by thread size. By rotating the hinge component, the distance between the housing of the hinge component and the selected one of the door and door frame can be changed thereby affecting alignment and sealing of the door.

The hinge bracket is attached to the other of the door and door frame. The hinge bracket preferably has an apertured flange extending outwardly from the selected one of the door and door frame.

The pin extends from the bracket and is received by the aperture of the hinge component for connecting the bracket with the hinge component. The pin is not press fit into the aperture and can be easily inserted or removed for allowing a door to be installed or removed from a door frame very quickly. The pin is preferably in the form of a threaded shaft of a bolt. A nut is threaded onto the shaft of the pin to retain the bearing member of the hinge component against the hinge bracket.

One embodiment is directed to a door assembly which comprises a door, a door frame, and the inventive door hinge. At least two door hinge components are adjustably attached to a selected one of the door and the door frame. Each door hinge component includes the housing and the elongated portion extending from the housing. The housing includes the rotatable bearing member disposed therein. Each hinge component is connected to the hinge bracket. One or more hinge brackets are fixedly mounted to the other one of the door and the door frame. Pins extend from the hinge brackets and through the bearing member apertures for connecting the door to the door frame. A separate pin may extend in each bearing member aperture or one pin may extend in both. The pin is preferably in the form of a bolt that fastens each of the hinge components to the hinge brackets using a nut. The nut is threaded onto the shaft to retain the bearing member against the hinge bracket. Removing a door simply requires the nut to be unfastened from the pin of each door hinge and the door lifted away. The door can be easily aligned by adjusting the distance between the housing of the hinge component and the selected one of the door and the frame. The adjustment device is preferably a fastener comprising threads formed on the elongated portion of the hinge component and an opening in the other of the door frame and the door that receives the threads. Rotating the hinge component changes the distance between the door frame and the door.

Another embodiment is directed to a method of attaching a door to a door frame which comprises the steps of fastening at least two door hinge components to a selected one of the door frame and the door. Each door hinge component includes the housing having the interior concave surface, the elongated portion extending from the housing, and the rotatable bearing member disposed in the housing. Preferably the hinge components are fastened by threading the elongated portion into the selected one of the door and the door frame. At least one hinge bracket is fastened to the complementary other of the door frame and the door. At least one pin extends from the hinge bracket and is aligned with the apertures of the hinge components and inserted therein such that the door is freely rotatable about the central axis of the pin.

Prior to inserting the pin, the alignment of the door is easily adjusted by rotating the elongated portion of the door hinge component. Rotating the hinge component changes the distance between the aperture of the hinge component and the selected one of the door or door frame.

The inventive door hinge advantageously allows one to quickly install or remove a door. For example, a door jamb can be painted quickly by removing the two nuts securing the pins, removing the door from the hinge components, painting the door jamb, and reinstalling the door. The entire process of installation and removal can be completed in approximately 30 to 60 seconds. Moreover, the door will not require any readjustment. A door using a conventional door hinge would require at least approximately 15 to 20 minutes for the entire process and most likely require readjustment.

Other embodiments of the invention are contemplated to provide particular features and structural variants of the basic elements. The specific embodiments referred to, as well as possible variations and the various features and advantages of the invention will become better understood from the detailed description that follows, when considered in connection with the accompanying drawings.

DETAILED DESCRIPTION OF THE PREFERRED EMBODIMENTS

Figure 1:
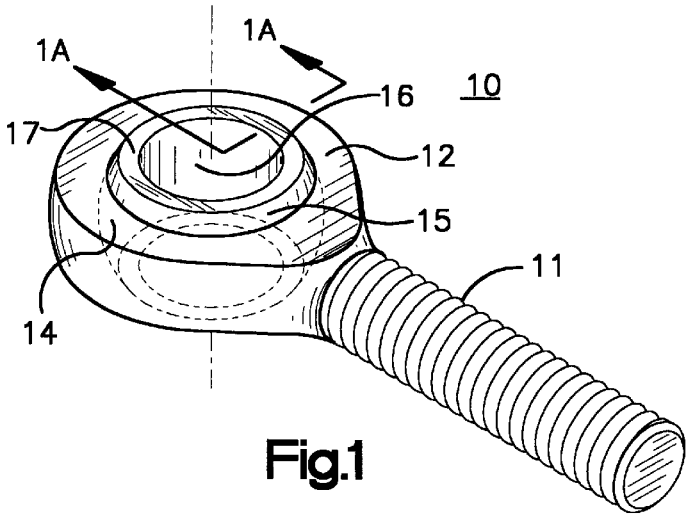
FIG. 1 is a perspective view of a hinge component constructed in accordance with the present invention.
Figure 1A:
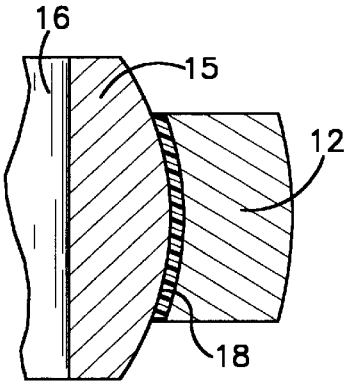
FIG. 1A is a cross sectional view as seen from a plane taken along the lines of 1A—1A of the hinge component of FIG. 1.

Referring now to the drawings and to FIG. 1 in particular, there is shown an adjustable, quick release door hinge component generally designated 10. The door hinge component 10 comprises a housing 12 and an elongated portion 11 extending from the housing 12. The elongated portion 11 is preferably threaded for adjustably attaching to an opening in a door frame. The housing 12 includes an interior concave surface 14 and a rotatable bearing member 15 is contained therein. The housing may optionally contain a bushing 18. The bushing has a shape that approximates the interior concave surface of the housing and is flush with upper and lower exterior surfaces of the housing, and reduces friction from contact of the bearing member with the housing. The bushing is preferably made from nylon or Teflon and helps prevent the accumulation of dirt, grime and grit from entering the housing. Other materials suitable for use will be apparent to those skilled in the art in view of this disclosure. Examples of suitable commercial nylon bushings include those sold under the trade name NYLOY. The bearing member 15 has an arcuate portion and an aperture 16 extends therethrough. The bearing member 15 is substantially spherical and includes opposing flat portions 17 on the top and bottom that protrude from the interior of the housing 12. The hinge component 10 and bearing member can be made of any metal, more preferably the metal is brass, steel, iron and alloys thereof. Other metals for use in the present invention would be apparent to one skilled in the art in view of this disclosure.

Figure 2:
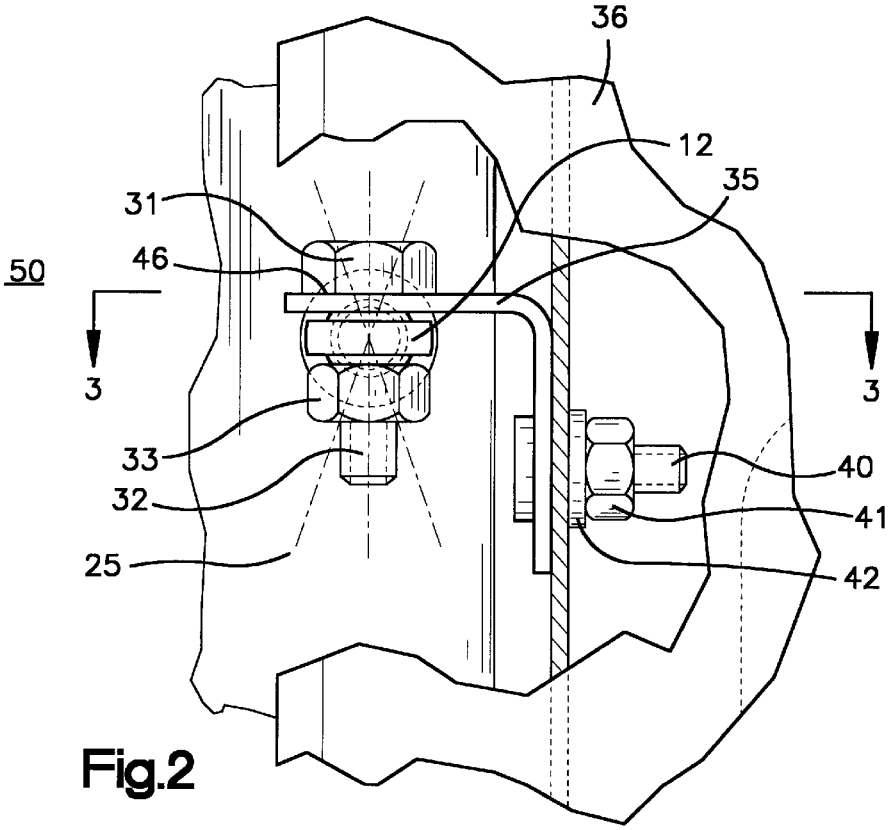
FIG. 2 is a cross sectional view showing the door hinge.
Figure 3:
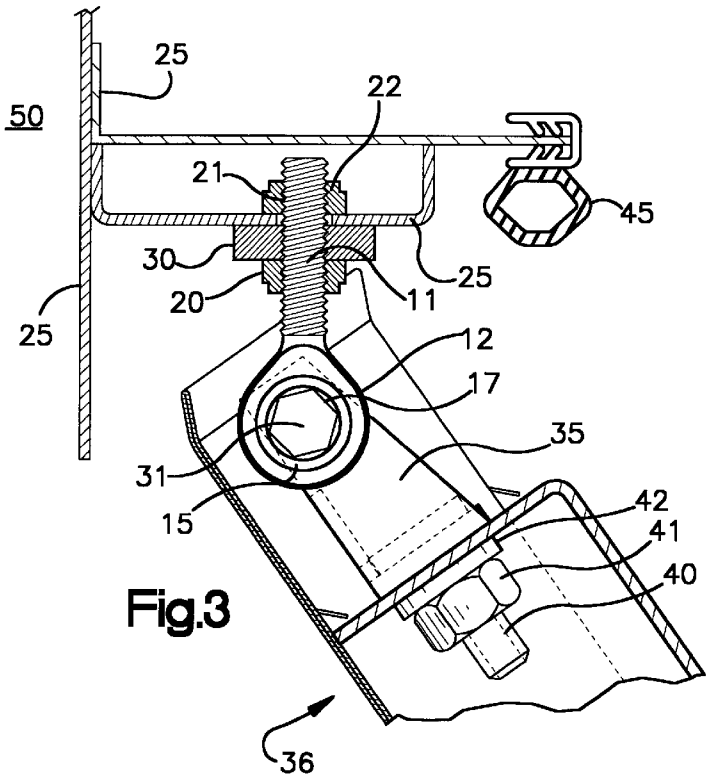
FIG. 3 is a cross sectional view as seen from a plane taken along the lines 3—3 of FIG. 2 of the door hinge in an opened position.

Turning now to FIGS. 2 and 3 of the drawings, there is shown a door hinge 50 for connecting a door 36 to a door frame 25 in opened and closed positions, respectively. The door hinge is preferably used for a compartment formed in the side of a truck, which can hold tools, equipment and the like. The door hinge comprises the door hinge component 10, a door hinge bracket 35 and a pin 31 for connecting a door to a door frame.

The door hinge component 10 is shown attached to the door frame 25. The door hinge component includes the housing 12 and the elongated portion 11 extending from the housing 12. The elongated portion is preferably threaded for adjustably attaching to an opening 21 in the door frame. The hinge component has a first nut 20 threaded onto the elongated portion. The nut 20 is positioned along the elongated portion so that a threaded portion of the elongated portion of the hinge component can be received by the opening 21 in the door frame 25. A second threaded nut 22 is attached to an interior door frame surface. The opening of the second nut is in alignment with the opening 21 in the door frame. Preferably, the nut 22 is welded to the interior door frame surface, although any means for attachment can be used and would be apparent to those skilled in the art in view of this disclosure. The hinge component 10 is threaded into the opening 21 in the door frame 25. The nut 20, positioned on the elongated portion 11 of the hinge component 10, is tightened by rotation such that the hinge component 10 is retained against the door frame 25. A washer 30 may be disposed between the first nut 20 and the door frame 25 for providing added strength to the door hinge 50 for supporting the weight of a door. The housing 12 of the hinge component is positioned on the door frame to receive the pin 31 extending from the hinge bracket 35 as shown in FIG. 3.

Unlike prior art door hinges, the present invention does not require the apertures of the hinge parts to be perfectly aligned for installation and removal, or even after the hinge parts have been installed in the door and door frame. The bearing member 15 of the present invention is pivotable (the extent to which being shown by dotted lines in FIG. 2) within the housing 12 of the hinge component, such that the bearing member aperture 16 can be tilted to be perfectly aligned with the pin extending from the hinge bracket. For instance, if the pin is off from vertical so as to extend along one of the pivot dotted lines in FIG. 2, such as when the brackets are not perfectly horizontal, the bearing member 15 tilts to enable the hinge component to be fastened to the hinge bracket despite the misalignment. The degree of pivot movement is dependent on the length of the bearing member portion protruding from the housing and on the location of the bearing aperture. Once the pin is secured and the hinge bracket is attached to the hinge component, the bearing member is rotatable to allow the opening and closing movement of a door connected to the door hinge. The pivotability of the bearing member advantageously lowers the criticality typically required with positioning hinge parts during door assembly.

The hinge bracket 35 is shown attached to the door 36 in FIGS. 2 and 3. The hinge bracket is preferably secured to the door by a bolt 40, washer 42 and nut 41, by welding (not shown) or the like. The hinge bracket as shown is preferably L-shaped with a portion of the bracket extending outwardly from the door. Each portion of the bracket extending outwardly preferably has an aperture 46. The size of the aperture on the hinge bracket is about the same size as the bearing member aperture 16 so that the portion of the hinge bracket extending outwardly will contact a flat portion 17 of the bearing member 15 of the hinge component when the hinge component and hinge bracket are secured to each other. The invention is not limited to any particular hinge bracket in this or in the following embodiments and may include C-shaped hinge brackets, multiple stacked aperture hinge brackets or other hinge brackets for door hinges known to those skilled in the art in view of this disclosure. The hinge bracket 35 should be of a suitable thickness and strength to support the weight of the door 36. Preferably the hinge bracket 35 is made of a metal, more preferably, the metal is steel or iron or an alloy thereof.

The apertures 16, 46 of the hinge component and the hinge bracket are aligned and the pin 31 is inserted. The pin is preferably a bolt with threads on a shaft portion 32. A nut 33 is threaded onto the shaft 32 for retaining the protruding portions of the bearing member 15 of the hinge component against the hinge bracket 35. The bearing member is rotatable in the housing and enables the door to be opened and closed.

Other variations are contemplated as part of the invention. For instance, the hinge bracket may be attached to the door frame whereas the hinge component is attached to the door. Also, the hinge bracket may be integrated with the selected one of the door and door frame. Moreover, the hinge bracket may be modified to have a shaft portion of a pin integrated into the hinge bracket, the shaft portion of the hinge bracket being inserted into the bearing member aperture.

Figure 4:
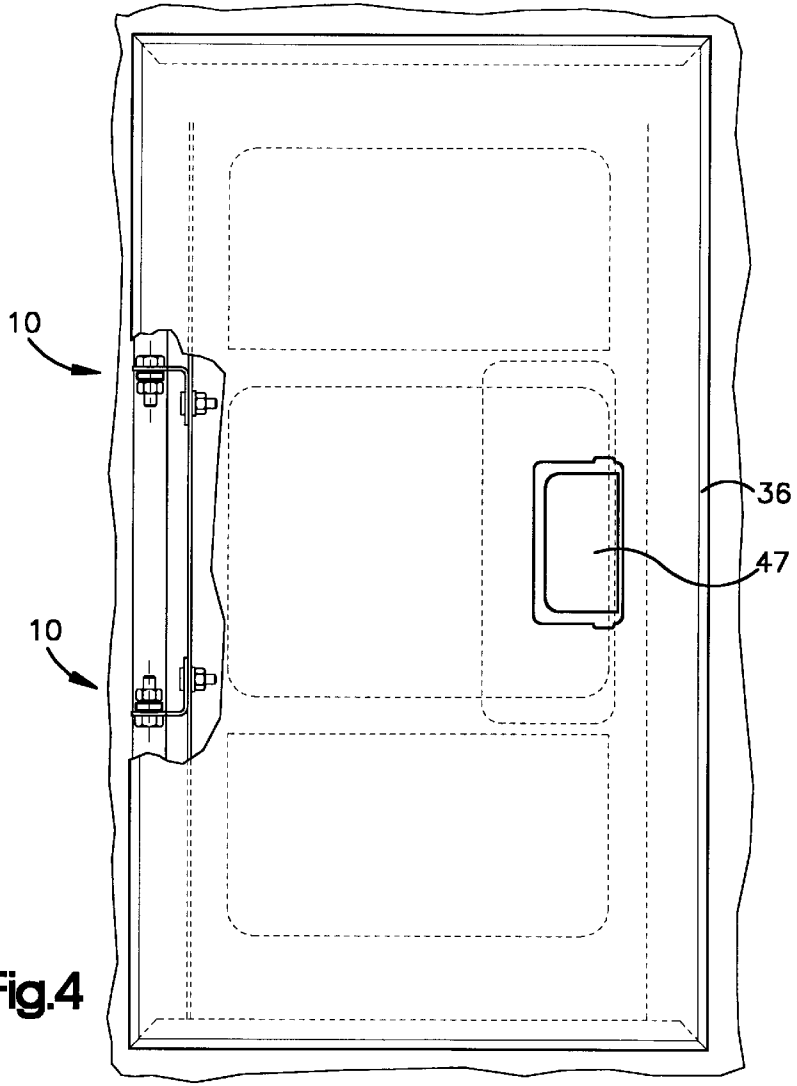
FIG. 4 is a partial cross sectional view of a door assembly including two door hinges constructed in accordance with the present invention.

Attaching a door to a door frame includes the steps of fastening at least two door hinge components 10 to the door frame 25 as shown in FIG. 4. Each hinge component 10 includes the housing 12 and the elongated portion 11 extending from the housing. The elongated portions of the hinge components are preferably threaded into openings 21 in the door frame. The housing of each hinge component includes the interior concave surface, and the rotatable bearing member 15 disposed in the housing. The bearing members each have an arcuate portion and the aperture 16. Portions of each bearing member protrude from the housing.

At least two door hinge brackets 35 are preferably attached to the door 36 in a position adjacent to the door hinge components 36. Alternatively, a single bracket with multiple bracket portions extending outwardly may be used. The hinge brackets are preferably attached to the door by a nut 41, washer 42 and bolt 40. Each hinge bracket 35 is preferably L-shaped and has a portion extending outwardly from the door. The portion extending outwardly has an aperture 46 (shown in FIG. 2).

The apertures 16, 46 of the hinge bracket and the hinge component are aligned. The pin 31 is inserted into the apertures such that the door hinge 50 is rotatable about the central axis of the pin.

Joints in the door assembly are preferably sealed by caulking (not shown) or lined with a gasket 45 as shown in FIGS. 3 and 4 with a suitable material such as foam rubber. Once the door assembly is completely assembled, a door latch 47 is mounted to the door. The latch preferably includes threaded studs for engaging threaded holes in the door of the assembly. A mechanism (not shown) is preferably welded to the inner door panel for latching and unlatching the door.

The alignment of the door 36 is easily adjusted in the present invention. The door is first removed from the quick release door hinges 50 by removing the pins 31 securing the hinge brackets 35 to the hinge components 10. The door connected to the hinge brackets 35 is removed and set aside. The elongated threaded portions 11 of each hinge component 10 are rotated to adjust the distance between the bearing member aperture 16 and the door frame 25. This distance defines how the door is aligned once the door is installed, that is, how close the door will be from the door frame. This adjustment can be made as fine as desired by using bolts having a large number of threads. For example, the elongated section of a suitable bolt has a 5/16 inch diameter and 24 threads per inch. After the distance between the bearing member aperture and the door frame is adjusted, the door is reinstalled by inserting pins into the hinge brackets and hinge components and securing with nuts.

The present invention advantageously enables a door to be installed or removed quickly. The inventive door hinge 10 includes pin 31 which can be easily installed or removed. During door installation, the hinge components are threaded into the door jamb and positioned to receive the door. The door is positioned such that the pin 31 extends from the hinge bracket 35 and is inserted into the hinge component aperture 16. The pin extending from the hinge bracket is not required to be perfectly vertical. The bearing member 15 of the hinge component can tilt within the housing 12 to enable the hinge component to be fastened to the hinge bracket despite misalignment. Moreover, the bearing member can tilt to compensate for some of the differences in the distance between the housing and the doorjamb that may occur between the hinge components. Nut 33 is fastened to secure the pin. During door removal, the nuts securing the pins are unfastened, the pins are removed and the door is lifted away from the door frame. Thus, the inventive door hinge enables doors to be installed or removed easily and quickly since it avoids the need for the precise alignment of the hinge pins and the hinge components.

Although the invention has been described in its preferred form with a certain degree of particularity, it is understood that the present disclosure of the preferred form has been made only by way of example and that numerous changes in the details of construction, operation and the combination and arrangement of parts may be resorted to without departing from the spirit and the scope of the invention as hereinafter claimed.

What is claimed is:

1. An adjustable quick release door hinge comprising in combination:

a hinge component comprising a housing including an interior concave surface, an elongated portion extending from said housing and a rotatable and pivotable bearing member disposed in said housing, said bearing member having an arcuate portion, opposing flat potions that protrude from the interior of said housing and an aperture;

a hinge bracket for attaching to one of a door frame and a door;

fastening means for connecting said hinge component to the other of the door frame and the door;

a pin extending from said hinge bracket and received by the aperture of said bearing member wherein an end of said pin includes a threaded shaft portion that extends beyond one of the flat portions of the bearing member; and a nut threaded onto said shaft portion for securing the hinge component to the hinge bracket, wherein said nut includes a surface in abutment with an entire flat surface of one of the flat portions of the bearing member and extending beyond said flat surface, and said hinge bracket includes a surface in abutment with an entire flat surface of the other of the flat portions of the bearing member and extending beyond said flat surface.

2. The door hinge of claim 1 wherein said fastening means comprises threads formed on said elongated portion and an opening in the other of the door frame and the door that receives said threads.

3. The door hinge of claim 1 wherein said hinge bracket is adapted to attach to a selected one of a vehicle door and a vehicle door frame.

4. The door hinge of claim 3 wherein said hinge bracket has an apertured flange extending outwardly from the selected one of said door and the door frame and is coaxially aligned with the bearing member aperture of the hinge component for receiving the pin.

5. The door hinge according to claim 1 wherein said hinge bracket is L-shaped and comprises substantially perpendicularly oriented flange portions including at least one aperture on each of said flange portions.

6. A door assembly comprising, in combination:

a door;

a door frame;

at least two door hinge components adjustably attached to a selected one of said door and said door frame, each of said door hinge components comprising a housing including an interior concave surface, an elongated portion extending from said housing attached to the selected one of said door and said door frame, and a rotatable and pivotable bearing member disposed in said housing, said bearing member having an arcuate portion, opposing flat portions protruding from the interior of said housing and an aperture;

a hinge bracket fixedly mounted to the other of said door and said door frame;

a pin inserted in each said bearing member aperture and extending from said hinge bracket for connecting the door to the door frame; and a nut threaded onto said shaft for securing the hinge component to the hinge bracket, wherein said nut includes a surface in abutment with an entire flat surface of one of the flat portions of the bearing member and extending beyond said flat surface, and said hinge bracket includes a surface in abutment with an entire flat surface of the other of the flat portions of the bearing member and extending beyond said flat surface.

7. The door assembly of claim 6 wherein said pin is a threaded shaft extending from a head of a bolt and a nut is threaded onto said shaft to retain said bearing member against said bracket.

8. The door assembly of claim 6 wherein said elongated portion of said hinge component comprises means for adjusting the distance between said housing and the selected one of said door and said frame.

9. The door assembly of claim 8 wherein said means for adjusting distance comprises threads formed on said elongated portion and an opening in the other of the door frame and the door that receives said threads.

10. A method of attaching a door to a door frame comprising the steps of:

fastening at least two door hinge components to a selected one of said door frame and said door, each said door hinge component comprising a housing having an interior concave surface, an elongated portion extending from said housing, and a rotatable and pivotable bearing member disposed in said housing, said bearing member having an arcuate portions opposing flat portions protruding from the interior of said housing and an aperture;

aligning a pin extending from a hinge bracket with each said bearing aperture;

inserting said pin into each said bearing aperture such that the door is freely pivotable about the central axis of said pin, wherein an end of said pin includes a threaded shaft portion that extends beyond the flat portions of the bearing member; and threading a nut onto said shaft portion for securing the hinge component to the hinge bracket, wherein said nut includes a surface in abutment with an entire flat surface of one of the flat portions of the bearing member and extending beyond said flat surface, and said hinge bracket includes a surface in abutment with an entire flat surface of the other of the flat portions of the bearing member and extending beyond said flat surface.

11. The method of claim 10 wherein said fastening step comprises threading said elongated portion of said door hinge component into an opening in the selected one of said door and said door frame.

12. The method of claim 11 comprising adjusting an alignment of the door by rotating the elongated portion of said hinge component to adjust the distance between the door and the door frame.

13. The method of claim 10 comprising pivoting said door hinge components wherein said door hinge is adapted to be pivotable about the central axis of each said pin to adjust a position of said door.

* * * * *